US008410674B2

(12) United States Patent
Nunome

(10) Patent No.: US 8,410,674 B2
(45) Date of Patent: Apr. 2, 2013

(54) SPARK PLUG WITH A CENTER ELECTRODE HAVING A SPACE-FORMING PORTION

(75) Inventor: Kenji Nunome, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/332,594

(22) Filed: Dec. 21, 2011

(65) Prior Publication Data

US 2012/0153800 A1 Jun. 21, 2012

(30) Foreign Application Priority Data

Dec. 21, 2010 (JP) ..... 2010-284379

(51) Int. Cl.
*H01T 13/20* (2006.01)

(52) U.S. Cl. ..... 313/141; 313/413

(58) Field of Classification Search ..... 313/140–143; 445/7

See application file for complete search history.

(56) References Cited

U.S. PATENT DOCUMENTS 7,408,294 B2 8/2008 Okabe et al.

FOREIGN PATENT DOCUMENTS

JP 2006-049207 A 2/2006
JP 2006-236906 A 9/2006

*Primary Examiner* — Joseph L Williams
(74) *Attorney, Agent, or Firm* — Leason Ellis LLP.

(57) ABSTRACT

A spark plug includes a tubular metallic shell; a tubular insulator in the tubular metallic shell located at a front end of the metallic shell and having an axial hole extending in the axial direction; and a center electrode inserted into the axial hole. The center electrode has a space-forming portion which forms, in cooperation with a wall surface of the axial hole, an annular space open frontward in the axial direction, and a main body portion extending rearward from the rear end of the space-forming portion. The thickness of the insulator is 0.6 mm or less as measured on a cross section and contains the front end of the metallic shell. The axial distance between the boundary portion and the front end of the metallic shell is 0.4 mm or greater, where the boundary portion is formed between the space-forming portion and the main body portion.

29 Claims, 6 Drawing Sheets

SPARK PLUG WITH A CENTER ELECTRODE HAVING A SPACE-FORMING PORTION

CROSS-REFERENCE TO THE RELATED APPLICATIONS

This application claims the benefit of Japanese Patent Application No. 2010-284379, filed Dec. 21, 2010, which is incorporated entirely by reference herein.

FIELD OF THE INVENTION

The present invention relates to a spark plug used for an internal combustion engine or the like.

BACKGROUND OF THE INVENTION

In general, a spark plug includes an insulator having an axial hole extending along the axis thereof, a center electrode inserted into the axial hole, a metallic shell provided around the insulator, and a ground electrode which is provided at a front end portion of the metallic shell and which forms a spark discharge gap in cooperation with the center electrode. When a predetermined voltage is applied to the center electrode, spark discharge occurs at the spark discharge gap, whereby an air-fuel mixture is ignited.

Incidentally, as a result of use of such a spark plug, deposit such as carbon may adhere to the surface of the insulator. When accumulation of such deposit on the surface of the insulator proceeds, anomalous spark discharge along the surface of the insulator (so-called lateral flying spark) may occur between the center electrode and the metallic shell. In order to restrain occurrence of anomalous discharge, there has been proposed a technique of providing a space-forming portion of relatively small diameter at the front end of the center electrode to thereby form an annular space (so-called thermo pocket) between the space-forming portion and the wall surface of the axial hole, the annular space being open frontward with respect to the axial direction (see, for example, Japanese Patent Application Laid-Open (kokai) No. 2006-49207).

Also, in recent years, reducing the diameter of a spark plug (metallic shell) is demanded for the purpose of, for example, increasing the degree of freedom of engine layout. However, merely reducing the diameter of only the metallic shell may result in excessive closeness between the metallic shell and the insulator. Therefore, the above-mentioned anomalous discharge, such as lateral flying spark, becomes more likely to occur. In view of such a problem, the wall thickness of the insulator may be reduced in order to secure a sufficiently large distance between the metallic shell and the insulator.

Problem to be Solved by the Invention

However, in a spark plug having a space-forming portion provided on its center electrode, electric field intensity increases at a boundary portion between the space-forming portion and a portion extending rearward from the rear end of the space-forming portion. Therefore, concentration of electric field intensity occurs in a region between the boundary portion and a front end portion of the metallic shell (particularly, a corner portion between the front end surface and inner circumferential surface of the metallic shell, at which electric field intensity is high). In the case where the insulator has a reduced wall thickness, penetration of discharge through the insulator may occur.

In recent years, there has been developed a combustion apparatus which utilizes a higher degree of compression and a higher degree of super charging in order to prevent drop in output while improving fuel consumption. However, in such a combustion apparatus, since a higher voltage is required for causing spark discharge, penetration of discharge through the insulator becomes more likely to occur. Moreover, in a lean burn engine or the like, since an air fuel mixture is lean (fuel concentration is low), an effect of cooling of a front end portion of the insulator by means of evaporation of the fuel becomes low, and the insulator becomes more likely to reach a higher temperature. Such overheating may lower the dielectric strength of the insulator, whereby penetration of discharge through the insulator may become more likely to occur.

SUMMARY OF THE INVENTION

The present invention has been conceived to solve the above-mentioned problems, and an object of the invention is to provide a spark plug in which a center electrode has a space-forming portion and an insulator has a relatively small wall thickness and which can effectively restrain penetration of discharge through the insulator. Means for Solving the Problems Configurations suitable for achieving the above object will next be described in itemized form. If needed, actions and effects peculiar to the configurations will be described additionally.

Configuration 1: a spark plug comprising:

a tubular metallic shell extending in a direction of an axis;

a tubular insulator provided in the metallic shell, having a front end located frontward of a front end of the metallic shell with respect to the direction of the axis, and having an axial hole extending in the direction of the axis; and a center electrode inserted into the axial hole and having a space-forming portion which forms, in cooperation with a wall surface of the axial hole, an annular space which is open frontward with respect to the direction of the axis, and a main body portion extending rearward from a rear end of the space-forming portion and having a diameter greater than that of the space-forming portion, the spark plug being characterized in that the insulator has a thickness of 0.6 mm or less as measured on a cross section which is orthogonal to the axis and contains the front end of the metallic shell; and a distance, as measured along the axis, between a boundary portion and the front end of the metallic shell is set to 0.4 mm or greater, where the boundary portion is formed between the space-forming portion and the main body portion.

According to the above-described configuration 1, the center electrode has a space-forming portion which forms an annular space in cooperation with the wall surface of the axial hole, and a portion of the insulator which faces the front end of the metallic shell and at which penetration is likely to occur has a reduced thickness of 0.6 mm or less. Therefore, occurrence of penetration of discharge through the insulator is very likely. However, according to the above-described configuration 1, a large distance of 0.4 mm or greater (as measured along the axis) is secured between the boundary portion and the front end of the metallic shell, where the boundary portion is formed between the space-forming portion and the main body portion (that is, between portions at which electric field intensity becomes relatively high). That is, although electric fields extending along the radial direction are mainly formed at the boundary portion between the space-forming portion and the main body portion and the boundary portion between the front end surface and inner circumferential surface of the metallic shell, concentration of electric field intensity can be restrained effectively by relatively greatly separating both the boundary portions in the axial direction (that is, in the direction intersecting the direction of the electric fields). As a result, penetration of discharge through the insulator can be prevented more reliably.

Configuration 2: a spark plug of the present configuration is characterized in that, in the above configuration 1, the distance, as measured along the axis, between the boundary portion and the front end of the metallic shell is set to 0.7 mm or greater, where the boundary portion is formed between the space-forming portion and the main body portion.

According to the above-described configuration 2, a larger distance of 0.7 mm or greater (as measured along the axis) is secured between the boundary portion and the front end of the metallic shell, where the boundary portion is formed between the space-forming portion and the main body portion. Therefore, concentration of electric field intensity can be restrained further, whereby penetration of discharge through the insulator can be prevented more reliably.

Configuration 3: a spark plug of the present configuration is characterized in that, in the above configuration 1 or 2, the clearance between the center electrode and the wall surface of the axial hole is set to 0.05 mm or less as measured on a cross section which is orthogonal to the axis and contains the rear end of the space-forming portion.

According to the above-described configuration 3, the clearance between the rear end of the space-forming portion and the wall surface of the axial hole is set to 0.05 mm or less. Accordingly, heat is efficiently conducted from the insulator [particularly, a portion thereof facing the boundary portion between the space-forming portion and the main body portion (that is, a portion at which penetration is very likely to occur)] to the center electrode, whereby overheating of the insulator can be restrained. As a result, a decrease in dielectric strength of the insulator due to overheating can be prevented more reliably, and, thus, penetration of discharge through the insulator can be prevented more effectively.

Configuration 4: a spark plug of the present configuration is characterized in that, in any of the above configurations 1 to 3, the center electrode includes an outer layer formed of a nickel alloy and an inner layer formed of a material which is higher in heat conductivity than the outer layer;

a front end of the inner layer is located frontward of the front end of the metallic shell with respect to the direction of the axis; and the outer layer has a thickness of 0.6 mm or less as measured on a cross section which is orthogonal to the axis and contains the front end of the metallic shell.

According to the above-described configuration 4, heat can be efficiently conducted from the insulator [particularly, a portion thereof facing the front end of the metallic shell (that is, a portion at which penetration is very likely to occur)] to the inner layer which is excellent in thermal conductivity. Accordingly, overheating of the insulator can be restrained, whereby a decrease in dielectric strength of the insulator can be restrained more reliably. As a result, the penetration resistance of the insulator can be increased further.

Configuration 5: a spark plug of the present configuration is characterized in that, in any of the above configurations 1 to 4, the insulator has a taper portion whose diameter increases rearward with respect to the direction of the axis, and is brought into direct or indirect contact with a step portion provided on the inner circumference of the metallic shell; and a distance, as measured along the axis, between the front end of the insulator and a rear end of the taper portion is set to 11 mm or less.

Although heat received by the insulator conducts to the step portion of the metallic shell via the center electrode, according to the above-described configuration 5, the distance between the front end of the insulator and the rear end of the taper portion; that is, the length of a heat conduction path along which heat of the insulator is conducted to the step portion of the metallic shell, is made sufficiently small. Accordingly, overheating of the insulator can be restrained more effectively, whereby penetration of discharge through the insulator can be prevented more reliably.

Configuration 6: a spark plug of the present configuration is characterized in that, in any of the above configurations 1 to 5, the space-forming portion includes a step portion whose diameter decreases frontward, with respect to the direction of the axis, from the front end of the main body portion, and a circular columnar portion extending frontward, with respect to the direction of the axis, from a front end of the step portion; and a half a difference in outer diameter between the rear end of the circular columnar portion and the front end of the main body portion is 0.05 mm or greater.

According to the above-described configuration 6, a half the difference in outer diameter between the rear end of the circular columnar portion and the front end of the main body portion is set to a sufficiently large value; i.e., 0.05 mm or greater. Therefore, an effect of increasing fouling resistance through provision of an annular space is attained more reliably.

Meanwhile, in the case where the space-forming portion has the step portion and the circular columnar portion, and a half the difference in outer diameter between the rear end of the circular columnar portion and the front end of the main body portion (that is, the amount of projection of the step portion in the radial direction) is large (0.05 mm or greater), the electric field intensity at the boundary portion between the space-forming portion (the step portion) and the main body portion increases further. Therefore, penetration of discharge through the insulator becomes more likely to occur. However, through employment of the above-described configuration 1, etc., such likeliness can be eliminated. In other words, it is meaningful that the above-described configuration 1, etc., is applied to spark plugs in which a half the above-mentioned diameter difference is set to 0.05 mm or greater and penetration of discharge through the insulator is more likely to occur.

Configuration 7: a spark plug of the present configuration is characterized in that, in any of the above configurations 1 to 6, a tapered chamfer portion or a curved surface portion which is convex outward is formed between the front end surface and the inner circumferential surface of the metallic shell.

According to the above-described configuration 7, a chamfer portion or a curved surface portion is formed between the front end surface and the inner circumferential surface of the metallic shell. Therefore, the electric field intensity at the boundary portion between the front end surface and the inner circumferential surface of the metallic shell can be decreased. As a result, penetration of discharge through the insulator can be prevented restrained further.

Configuration 8: a spark plug of the present configuration is characterized in that, in any of the above configurations 1 to 7, the metallic shell has, on its outer circumferential surface, a threaded portion for screwing the spark plug into a mounting hole of a combustion apparatus; and the threaded portion has a nominal diameter of M10 or less.

From the viewpoint of restraining concentration of electric field intensity, the boundary portion between the space-forming portion and the main body portion and the front end of the metallic shell may be separated in the radial direction (the direction orthogonal to the axis). However, in the case of a spark plug in which the metallic shell has a nominal diameter of M10 or less as in the above-described configuration 8, separating the two boundary portions in the radial direction is difficult. Therefore, employment of the above-described configuration 1, etc. (separating the two boundary portions along the axial direction) is a very simple and easy method for realizing the restraint of concentration of electric field intensity in such a spark plug. That is, the above-described configuration 1, etc. is particularly meaningful for spark plugs in which the nominal diameter is M10 or less, and separating the two boundary portions in the radial direction is difficult.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Mode for Carrying out the Invention

Figure 1:
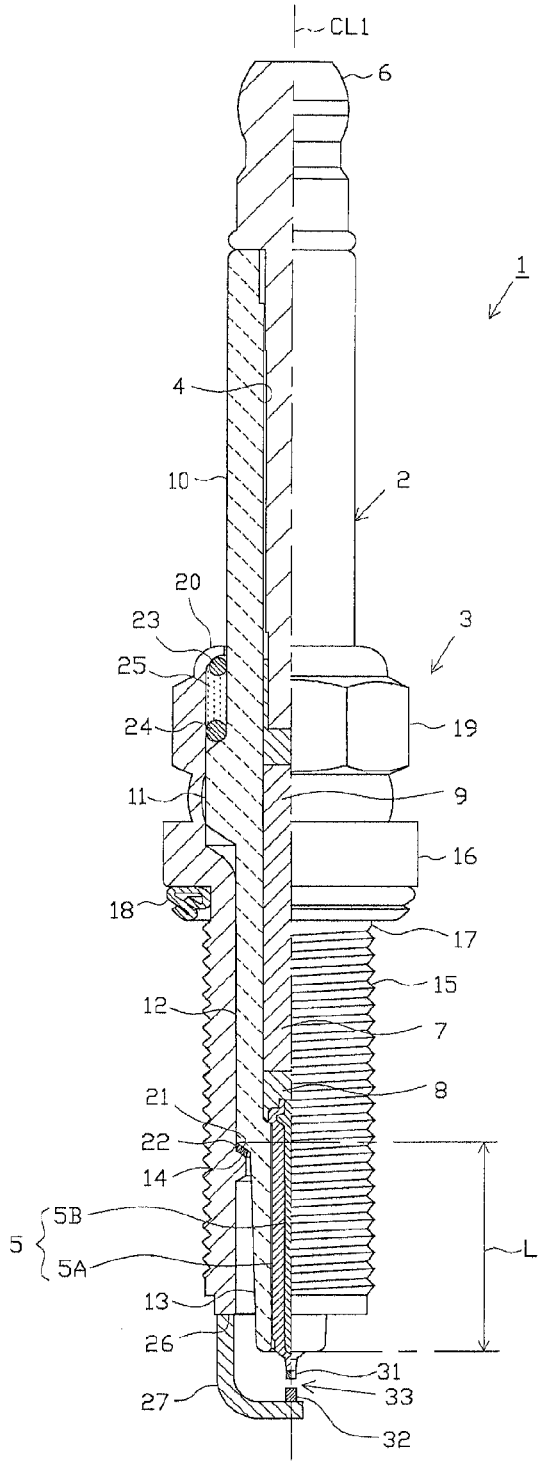
FIG. 1 is a partially sectioned front view showing the configuration of a spark plug.

One embodiment will next be described with reference to the drawings. FIG. 1 is a partially sectioned front view showing a spark plug 1. Notably, in FIG. 1, the direction of an axis CL1 of the spark plug 1 is referred to as the vertical direction. In the following description, the lower side of the spark plug 1 in FIG. 1 is referred to as the front end side of the spark plug 1, and the upper side as the rear end side.

The spark plug 1 includes a tubular insulator 2, a tubular metallic shell 3, which holds the insulator 2 therein, etc.

The insulator 2 is formed from alumina or the like by firing, as well known in the art. The insulator 2, as viewed externally, includes a rear trunk portion 10 formed on the rear end side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. The large-diameter portion 11, the intermediate trunk portion 12, and the greater portion of the leg portion 13 of the insulator 2 are accommodated within the metallic shell 3. Meanwhile, the front end of the insulator 2 projects frontward from the front end of the metallic shell 3. In addition, a taper portion 14 is formed at a connection portion between the intermediate trunk portion 12 and the leg portion 13 such that the diameter of the taper portion 14 increases rearward. The insulator 2 is seated on the metallic shell 3 at the taper portion 14.

Further, the insulator 2 has an axial hole 4 extending therethrough along the axis CL1. A center electrode 5 is fixedly inserted into a front end portion of the axial hole 4. The center electrode 5 is composed of an outer layer 5A formed of a Ni alloy which contains nickel (Ni) as a main component, and an inner layer 5B formed of a metal (e.g., copper. a copper alloy, pure Ni, etc.) which is higher in thermal conductivity than the Ni alloy that constitutes the outer layer 5A. The front end of the inner layer 5B is located frontward of the front end of the metallic shell 3. The center electrode 5 has a rodlike shape (circular columnar shape) as a whole, and has a flat front end surface. The front end surface of the center electrode 5 projects from the front end of the insulator 2. A circular columnar noble metal portion 31 formed of a certain noble metal alloy (e.g., platinum alloy or iridium alloy) is provided at the front end of the center electrode 5.

Also, a terminal electrode 6 is fixedly inserted into a rear end portion of the axial hole 4 and projects from the rear end of the insulator 2.

A circular columnar resistor 7 is disposed within the axial hole 4 between the center electrode 5 and the terminal electrode 6. Opposite end portions of the resistor 7 are electrically connected to the center electrode 5 and the terminal electrode 6, respectively, via electrically conductive glass seal layers 8 and 9.

The metallic shell 3 is formed into a tubular shape from a low-carbon steel or a like metal. The metallic shell 3 has, on its outer circumferential surface, a threaded portion (externally threaded portion) 15 adapted to mount the spark plug 1 into a mounting hole of a combustion apparatus (e.g., an internal combustion engine or a fuel cell reformer). Also, the metallic shell 3 has, on its outer circumferential surface, a seat portion 16 located rearward of the threaded portion 15. A ring-like gasket 18 is fitted to a screw neck 17 at the rear end of the threaded portion 15. Further, the metallic shell 3 has, near the rear end thereof, a tool engagement portion 19 having a hexagonal cross section and allowing a tool, such as a wrench, to be engaged therewith when the metallic shell 3 is to be mounted to the combustion apparatus. Also, the metallic shell 3 has a crimp portion 20 provided at a rear end portion thereof for retaining the insulator 2.

Also, a tapered step portion 21 is formed on the inner circumferential surface of the metallic shell 3 so as to receive the insulator 2, which butts against the step portion 21. The insulator 2 is inserted frontward into the metallic shell 3 from the rear end of the metallic shell 3. In a state in which the taper portion 14 of the insulator 2 butts against the step portion 21 of the metallic shell 3, a rear-end opening portion of the metallic shell 3 is crimped radially inward; i.e., the above-mentioned crimp portion 20 is formed, whereby the insulator 2 is fixed to the metallic shell 3. An annular sheet packing 22 intervenes between the taper portion 14 of the insulator 2 and the step portion 21 of the metallic shell 3. This retains gastightness of a combustion chamber and prevents outward leakage of fuel gas which enters the clearance between the inner circumferential surface of the metallic shell 3 and the leg portion 13 of the insulator 2, which is exposed to the combustion chamber.

Further, in order to ensure gastightness which is established by crimping, annular ring members 23 and 24 intervene between the metallic shell 3 and the insulator 2 in a region near the rear end of the metallic shell 3, and a space between the ring members 23 and 24 is filled with powder of talc 25. That is, the metallic shell 3 holds the insulator 2 via the sheet packing 22, the ring members 23 and 24, and the talc 25.

Figure 2:
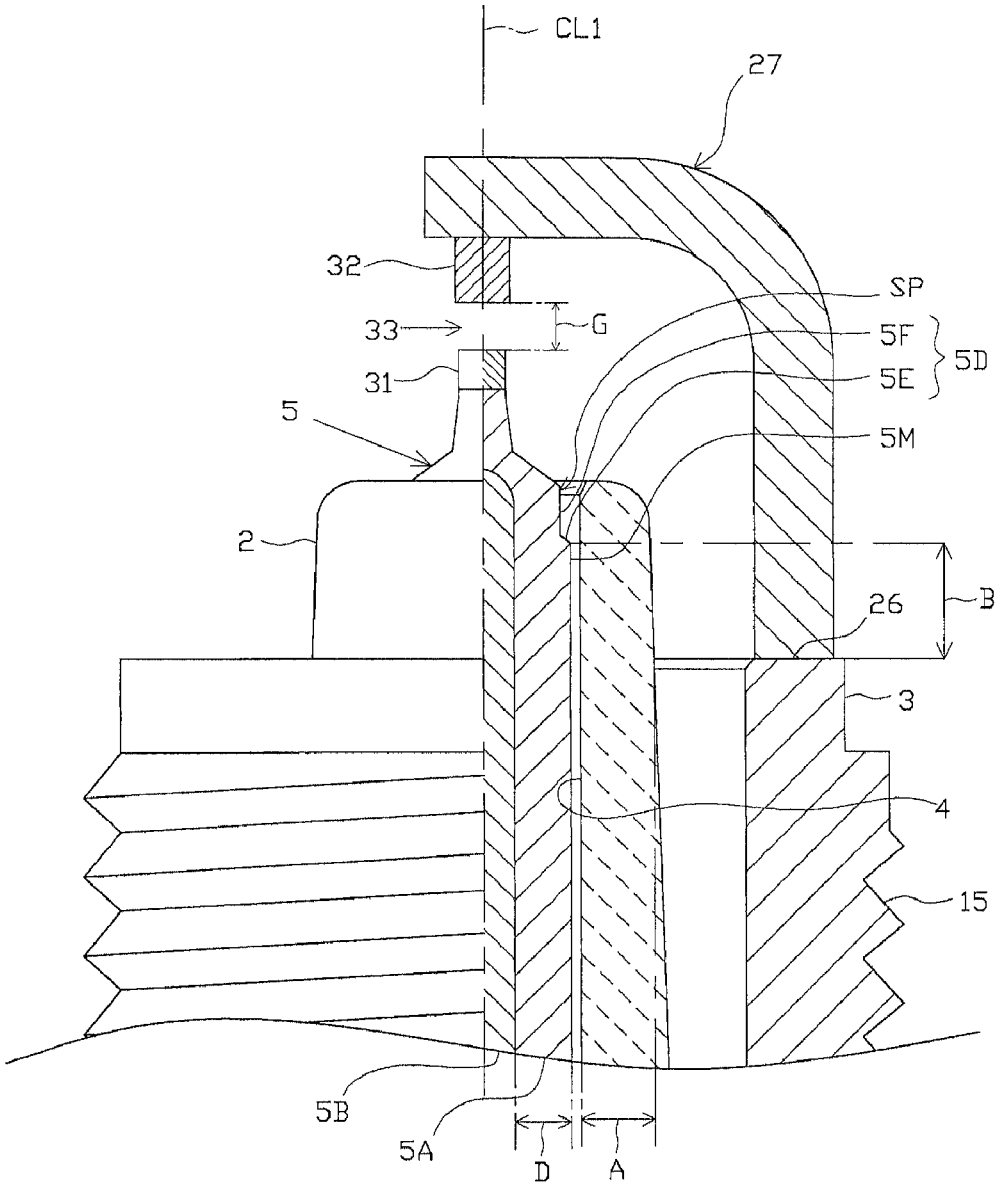
FIG. 2 is an enlarged, partially sectioned front view showing the configuration of a front end portion of the spark plug.

As shown in FIG. 2, a rod-shaped ground electrode 27 is joined to the front end 26 of the metallic shell 3. The ground electrode 27 is bent at an approximately central portion thereof, and its distal end portion faces a front end portion (the noble metal portion 31) of the center electrode 5. The ground electrode 27 is formed of a Ni alloy whose main component is Ni, and a circular columnar noble metal chip 32 is joined to a portion of the ground electrode 27, the portion facing the noble metal portion 31. The noble metal tip 32 is formed of a metal containing a specific noble metal (e.g., a noble metal such as iridium or platinum, or a noble metal alloy containing any of these noble metals).

A spark discharge gap 33 is formed between the center electrode 5 (the noble metal portion 31) and the noble metal tip 32, and spark discharge occurs at the spark discharge gap 33 in a direction along the axis CL1. Notably, in the present embodiment, since the size G of the spark discharge gap 33 is rendered relatively large (e.g., 0.9 mm or greater) in order to improve igniting performance, the voltage (discharge voltage) required for spark discharge is relatively high.

Further, in the present embodiment, in order to decrease the diameter of the spark plug 1, the metallic shell 3 is made relatively small in diameter, and the threaded portion 15 has a relatively small nominal diameter (M10 or less). In order to cope with the decreased diameter of the metallic shell 3, the diameter of the insulator 2 is reduced. In the present embodiment, the insulator 2 has a thickness A of 0.6 mm or less as measured on a cross section which is orthogonal to the axis CL1 and contains the front end 26 of the metallic shell 3. By virtue of this configuration, a sufficiently large distance is secured between the front end 26 of the metallic shell 3 and the outer circumferential surface of the insulator 2 (the leg portion 13) as measured along a direction orthogonal to the axis CL1. Thus, occurrence of anomalous spark discharge (so-called lateral flying spark, etc.) between the center electrode 5 and the front end 26 of the metallic shell 3 is restrained. Notably, preferably, the thickness A of the insulator 2 is set to 0.4 mm or greater in order to prevent excessive decrease in the dielectric strength of the insulator 2.

In addition, the center electrode 5 has a space-forming portion 5D and a main body portion 5M. The space-forming portion 5D forms an annular space SP (so-called thermo pocket) in cooperation with the wall surface of the axial hole 4, the annular space SP being open frontward. The main body portion 5M extends rearward from the rear end of the space-forming portion 5D, and is greater in diameter than the space-forming portion 5D.

Figure 3:
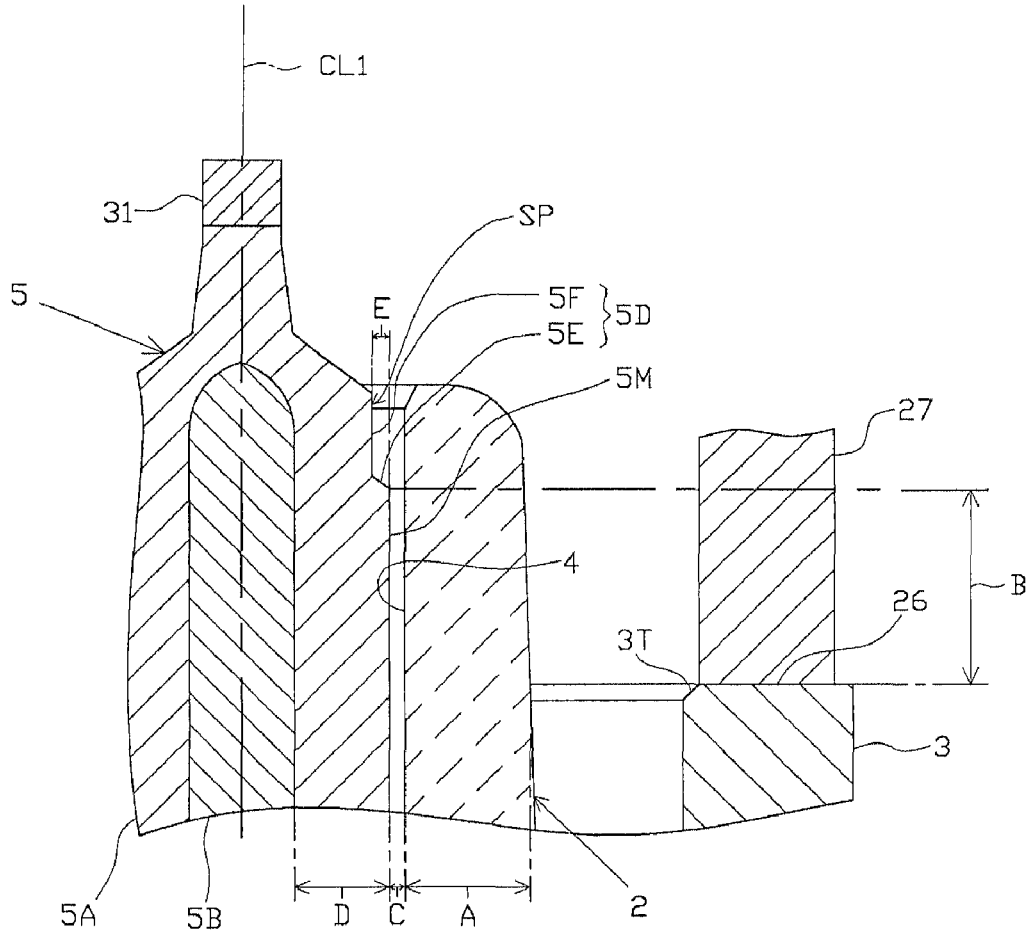
FIG. 3 is an enlarged partial cross section showing the thickness A of an insulator, etc.

The space-forming portion 5D has a step portion 5E whose diameter decreases from the front end of the main body portion 5M toward the front end side with respect to the direction of the axis CL1; and a circular columnar portion 5F which extends frontward from the front end of the step portion 5E. Also, in the present embodiment, in order to secure a sufficiently large dimension (as measured in the radial direction) of the annular space SP formed between the space-forming portion 5D and the wall surface of the axial hole 4, the diameter of the rear end of the circular columnar portion 5F and that of the front end of the main body portion 5M are determined such that a half the difference between the diameters, which is represented by E (mm) as shown in FIG. 3, satisfies a relation $E \geqq 0.05$. Since $E \geqq 0.05$, the electric field intensity at a corner portion formed between the space-forming portion 5D (the step portion 5E) and the main body portion 5M is relatively high.

Moreover, in the present embodiment, the distance B (as measured along the axis CL1) between the front end 26 of the metallic shell 3 and a boundary portion between the space-forming portion 5D (the step portion 5E) and the main body portion 5M is set to 0.4 mm or greater (more preferably, 0.7 mm or greater). That is, the spark plug 1 is configured such that the boundary portion (corner portion) between the space-forming portion 5D and the main body portion 5M and a boundary portion between the front end surface and the inner circumferential surface of the metallic shell 3, at which boundary portions the electric field intensity becomes relatively high, are separated from each other along the direction of the axis CL1.

Also, as measured on a cross section which is orthogonal to the axis CL1 and includes the rear end of the space-forming portion 5D (the step portion 5E), the size of the clearance C between the center electrode 5 and the wall surface of the axial hole 4 is set to 0.05 mm or less. Therefore, the insulator 2 and the main body portion 5M are sufficiently close to each other.

In addition, the center electrode 5 is configured such that the thickness D of the outer layer 5A, as measured on a cross section which is orthogonal to the axis CL1 and includes the front end 26 of the metallic shell 3, is set to 0.6 mm or less. That is, the center electrode 5 is configured such that the inner layer 5B, which is excellent in thermal conductivity, is relatively close to a portion of the insulator 2 which faces the front end 26 of the metallic shell 3.

Moreover, the distance L between the front end of the insulator 2 and the rear end of the taper portion 14, as measured along the axis CL1, is set to 11 mm or less (see FIG. 1).

Also, in the present embodiment, a tapered chamfer portion 3T is formed between the front end surface and the inner circumferential surface of the metallic shell 3. Preferably, the width of the chamfer portion 3T is rendered sufficiently large (0.1 mm or greater).

As described in detail above, in the spark plug 1 according to the present embodiment, the center electrodes has the space-forming portion 5D, the thickness A of the insulator 2 is set to 0.6 mm or less, and the distance E is set to 0.05 mm or greater. Accordingly, penetration of discharge through the insulator 2 is very likely to occur. However, in the present embodiment, the distance B (as measured along the axis CL1) between the boundary portion and the front end of the metallic shell 3, where the boundary portion is formed between the space-forming portion 5D and the main body portion 5M (that is, between portions at which electric field intensity becomes relatively strong) is rendered large (0.4 mm or greater). Accordingly, it is possible to effectively restrain concentration of electric field intensity at the boundary portion between the space-forming portion 5D and the main body portion 5M and/or at the boundary portion between the front end surface and the inner circumferential surface of the metallic shell 3. As a result, penetration of discharge through the insulator 2 can be prevented more reliably.

Moreover, since the clearance C is set to 0.05 mm or less, heat of the insulator 2 can be efficiently conducted to the center electrode 5. Also, since the thickness D of the outer layer 5A is set to 0.6 mm or less, heat of the insulator 2 can be efficiently conducted to the inner layer 5B of the center electrode 5, which is excellent in thermal conductivity. Furthermore, since the distance L (corresponding to the length of a heat conduction path along which heat of the insulator 2 is conducted to the step portion 21 of the metallic shell 3) is set to 11 mm or less, heat of the insulator 2 can be efficiently conducted to the step portion 21 of the metallic shell 3 via the center electrode 5. As described above, by means of setting the clearance C, the thickness D, and the distance L are set to fall within the above-described respective numerical ranges, overheating of the insulator 2 can be restrained quite effectively, and decrease in dielectric strength of the insulator 2 can be prevented more reliably. As a result, penetration of discharge through the insulator 2 can be prevented more reliably.

In order to confirm the action and effect achieved by the above-described embodiment, an insulator penetration test was carried out on samples (spark plugs) manufactured as follows. While the size G of the spark discharge gap was set to 1.2 mm or 1.5 mm, the thickness A (mm) of the insulator, the axial distance B (mm) between the front end of the metallic shell and the boundary portion between the space-forming portion and the main body portion, the clearance C (mm) between the rear end of the space-forming portion (the main body portion) and the wall surface of the axial hole, the thickness D (mm) of the outer layer as measured at the front end of the metallic shell, the half E (mm) the difference between the outer diameter of the rear end of the circular columnar portion and that of the front end of the main body portion, and the distance L (mm) between the front end of the insulator and the rear end of the taper portion were changed various manner. Twenty samples (spark plugs) were manufactured for each of combinations of values of A, B, C, D, E, and L. In the insulator penetration test, four samples are attached to a 4-cylinder turbo engine (displacement: 1.6 L), and the engine was operated in a full throttle state (=5000 rpm). Every 2.5 hours, the cylinders to which the samples were attached were changed successively and the engine was operated in a full throttle state, so that the engine was operated for 10 hours in total. After elapse of 10 hours, whether or not penetration of discharge through the insulator occurred was checked, and the ratio (penetration incidence) of the number of samples having exhibited penetration of discharge through the insulator among the 20 samples was calculated.

Of the samples in which the size G of the spark discharge gap was set to 1.2 mm, samples whose penetration incidence was 0% were evaluated "Good" because they can effectively restrain penetration of discharge through the insulator. Of the samples in which the size G of the spark discharge gap was set to 1.5 mm (that is, samples which are higher in discharge voltage and in which penetration of discharge through the insulator is more likely to occur), samples whose penetration incidence was 0% were evaluated "Excellent" because they can quite effectively restrain penetration of discharge through the insulator. Meanwhile, of the samples in which the size G of the spark discharge gap was set to 1.2 mm, samples in which penetration of discharge through the insulator occurred were evaluated "Poor" because penetration of discharge through the insulator is somewhat likely to occur. Table 1 shows the results of the test. Notably, the sign "–" of the distance B in Table 1 indicates that the boundary portion between the space-forming portion and the main body portion is located rearward of the front end of the metallic shell. That is, the distance B assumes a positive value when the boundary portion is located frontward of the front end of the metallic shell (reference), and assumes a negative value when the boundary portion is located rearward of the front end of the metallic shell.

Notably, in samples Nos. 1 to 15, 19 to 25, and 27 to 29, since the length of the inner layer of the center electrode is made relatively short, its front end does not reach the front end of the metallic shell (that is, the thickness D of the outer layer cannot be measured). Sample No. 27 was configured such that a chamfer portion was provided between the front end surface and inner circumferential surface of the metallic shell, and the remaining samples were configured such that the front end surface and inner circumferential surface of the metallic shell perpendicularly intersect each other on a cross section containing the axis. Sample No. 2 was configured such that the center electrode had no space-forming portion (that is, the distance E was set to 0.0 mm). Samples Nos. 1 to 4 and 6 to 27 were configured such that the front end of the main body portion had an outer diameter of 2.1 mm, and samples Nos. 5, 28, and 29 were configured such that the front end of the main body portion had an outer diameter of 1.9 mm (that is, samples Nos. 5, 28, and 29 had a configuration in which heat of the insulator is conducted less, and penetration of discharge through the insulator is more likely to occur).

Figure 4:
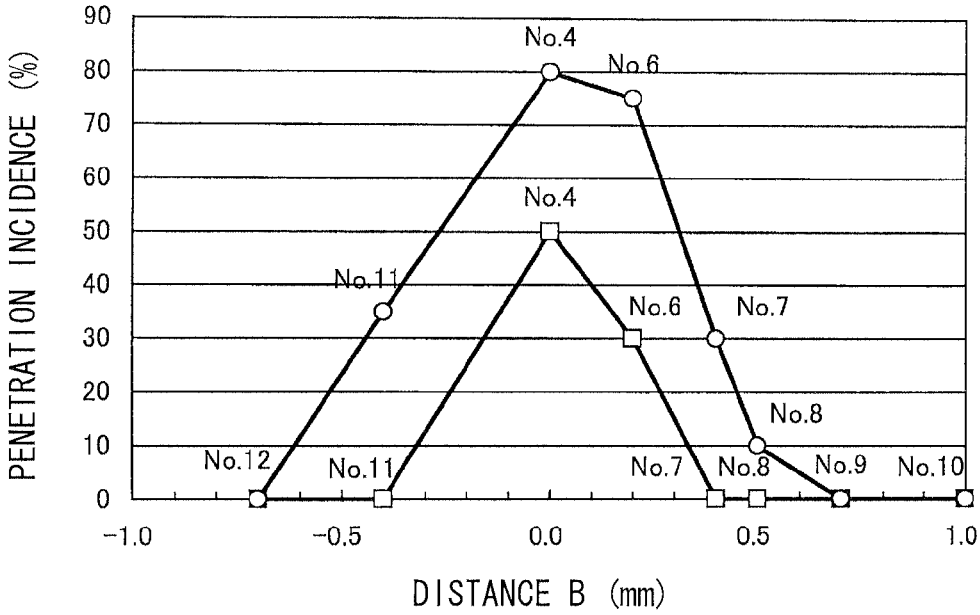
FIG. 4 is a graph showing results of an insulator penetration test performed by use of samples which are different in distance B from one another.
Figure 5:
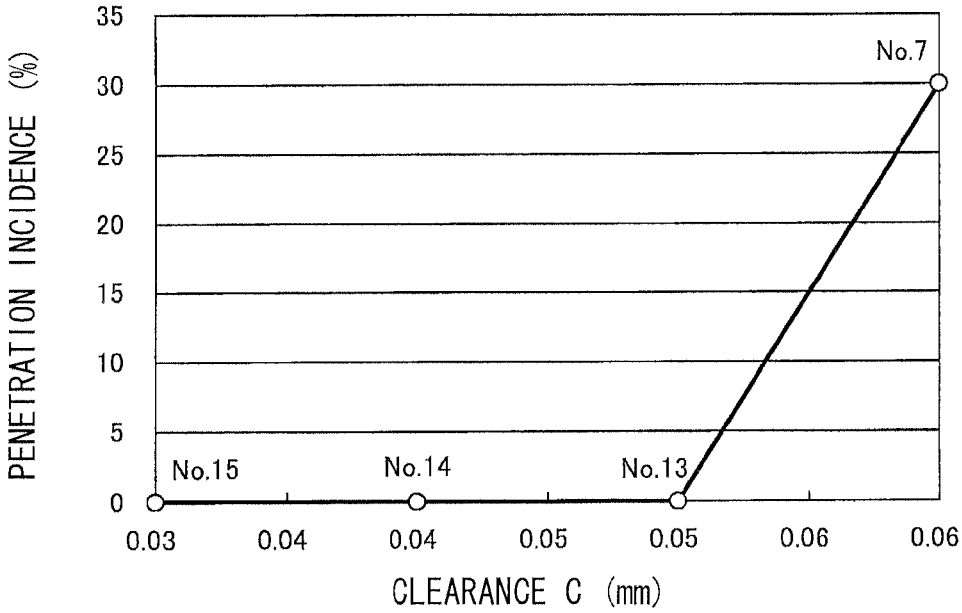
FIG. 5 is a graph showing results of an insulator penetration test performed by use of samples which are different in clearance C from one another.
Figure 6:
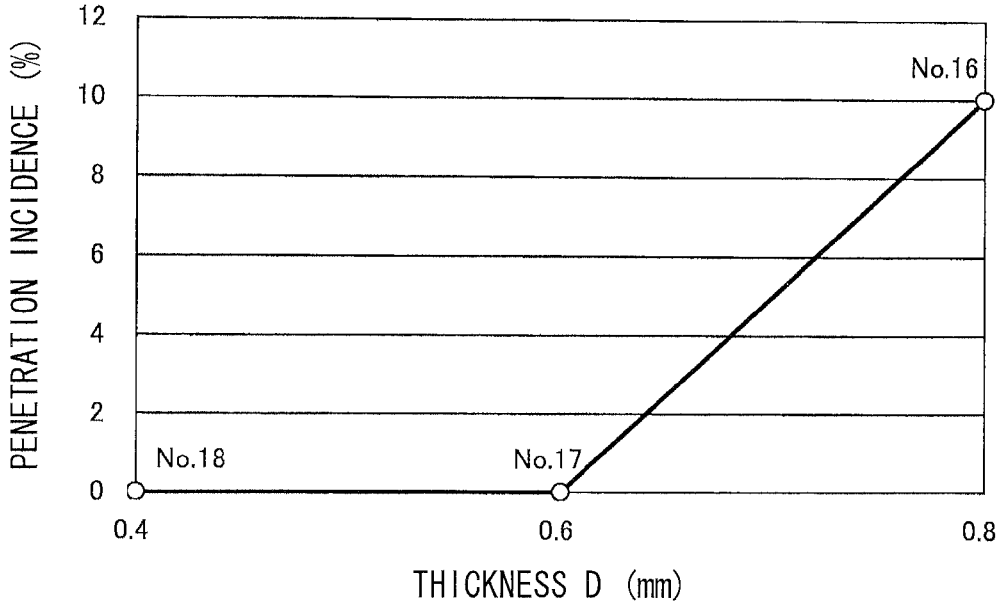
FIG. 6 is a graph showing results of an insulator penetration test performed by use of samples which are different in thickness D from one another.
Figure 7:
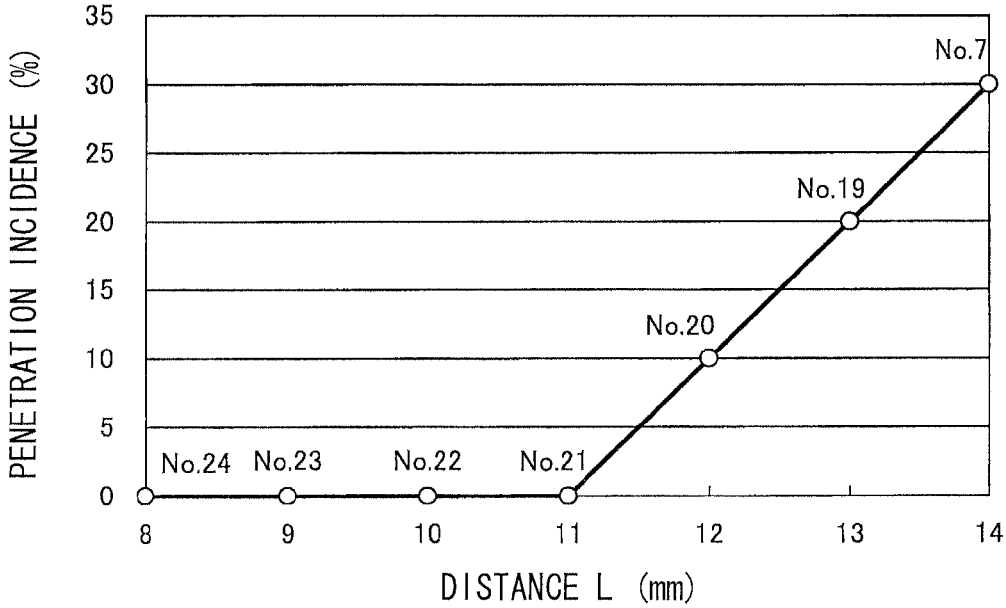
FIG. 7 is a graph showing results of an insulator penetration test performed by use of samples which are different in distance L from one another.

FIG. 4 is a graph showing the extracted test results of samples Nos. 4 and 6 to 12, which differ from one another only in the distance B, and FIG. 5 is a graph showing the extracted test results of samples Nos. 7 and 13 to 15, which differ from one another only in the clearance C. FIG. 6 is a graph showing the extracted test results of samples Nos. 16 to 18, which differ from one another only in the thickness D, and FIG. 7 is a graph showing the extracted test results of samples Nos. 7 and 19 to 24, which differ from one another only in the distance L. Notably, in FIG. 4, the test results of the samples in which the size G of the spark discharge gap was set to 1.2 mm are indicted by square marks, and the test results of the samples in which the size G of the spark discharge gap was set to 1.5 mm are indicted by circular marks. FIGS. 5 to 7 show only the test results of the samples in which the size G of the spark discharge gap was set to 1.5 mm.

TABLE 1

| No. | A (mm) | B (mm) | C (mm) | D (mm) | E (mm) | L (mm) | CHAMFER | OD OF MAIN BODY FRONT END | PENETRATION INCIDENCE G = 1.2 mm | PENETRATION INCIDENCE G = 1.5 mm | EVALUATION |
|---|---|---|---|---|---|---|---|---|---|---|---|
| 1 | 0.8 | 0.0 | 0.06 | — | 0.10 | 14 | NOT | 2.1 mm | 0 | 0 | Excellent |
| 2 | 0.6 | | | | 0.00 | | PROVIDED | | 0 | 10 | Good |
| 3 | | | | | 0.05 | | | | 20 | 50 | Poor |
| 4 | | | | | 0.10 | | | | 50 | 80 | Poor |
| 5 | | | | | | | | 1.9 mm | 55 | 85 | Poor |
| 6 | | 0.2 | | | | | | 2.1 mm | 30 | 75 | Poor |
| 7 | | 0.4 | | | | | | | 0 | 30 | Good |
| 8 | | 0.5 | | | | | | | 0 | 10 | Good |
| 9 | | 0.7 | | | | | | | 0 | 0 | Excellent |
| 10 | | 1.0 | | | | | | | 0 | 0 | Excellent |
| 11 | | −0.4 | | | | | | | 0 | 35 | Good |
| 12 | | −0.7 | | | | | | | 0 | 0 | Excellent |

TABLE 1-continued

| No. | A (mm) | B (mm) | C (mm) | D (mm) | E (mm) | L (mm) | CHAMFER | OD OF MAIN BODY FRONT END | PENETRATION INCIDENCE G = 1.2 mm | PENETRATION INCIDENCE G = 1.5 mm | EVALUATION |
|---|---|---|---|---|---|---|---|---|---|---|---|
| 13 | | 0.4 | 0.05 | | | | | | 0 | 0 | Excellent |
| 14 | | | 0.04 | | | | | | 0 | 0 | Excellent |
| 15 | | | 0.03 | | | | | | 0 | 0 | Excellent |
| 16 | | | 0.06 | 0.8 | | | | | 0 | 10 | Good |
| 17 | | | | 0.6 | | | | | 0 | 0 | Excellent |
| 18 | | | | 0.4 | | | | | 0 | 0 | Excellent |
| 19 | | | | — | | 13 | | | 0 | 20 | Good |
| 20 | | | | | | 12 | | | 0 | 10 | Good |
| 21 | | | | | | 11 | | | 0 | 0 | Excellent |
| 22 | | | | | | 10 | | | 0 | 0 | Excellent |
| 23 | | | | | | 9 | | | 0 | 0 | Excellent |
| 24 | | | | | | 8 | | | 0 | 0 | Excellent |
| 25 | | | | | 0.05 | 14 | | | 0 | 20 | Good |
| 26 | | | | 0.6 | 0.10 | 11 | | | 0 | 0 | Excellent |
| 27 | | | | — | 0.15 | 14 | PROVIDED | | 0 | 0 | Excellent |
| 28 | | | | | 0.10 | | NOT | 1.9 mm | 0 | 35 | Good |
| 29 | | 0.7 | | | | | PROVIDED | | 0 | 0 | Excellent |

As shown in Table 1, it was found that, in sample No. 1, in which the thickness A was set to a sufficiently large value of 0.8 mm, penetration of discharge through the insulator did not occur; however, in sample No. 4, which differs from sample No. 1 only in the point that the thickness A was set to 0.6 mm or less, the penetration of discharge through the insulator was highly likely to occur. That is, it was confirmed that when an insulator whose thickness A is 0.6 mm or less is used, penetration is more likely to occur.

The test results reveal that, in sample No. 2, in which the distance E was set to 0.0 mm (that is, the space-forming portion was not provided), penetration of discharge through the insulator was unlikely to occur; however, in sample No. 3, which differs from sample No. 2 only in the point that the distance E was set to 0.05 mm, penetration of discharge through the insulator was highly likely to occur. That is, it was confirmed that, in the case where the center electrode has the space-forming portion and the electric field intensity at the boundary portion between the space-forming portion and the main body portion increases, penetration of discharge through the insulator is more likely to occur. In addition, it was found from the test results of samples Nos. 3 and 4 that the larger the distance E, the greater the possibility of occurrence of penetration of discharge through the insulator.

From the above-described test results, it is considered that, in samples Nos. 3 to 29, in which the thickness A is 0.6 mm or less and the distance E is greater than 0.0 mm, penetration is highly likely to occur. However, it was found that, as shown in Table 1 and FIG. 4, by setting the distance B to 0.4 mm or grater (samples Nos. 7 to 29), penetration of discharge through the insulator is restrained effectively. Conceivably, this effect can be attained through restraint of concentration of electric field intensity, which can be realized by separating, along the axial direction, the boundary portion between the space-forming portion and the main body portion, and the corner (boundary portion) between the front end surface and inner circumferential surface of the metallic shell, at which electric field intensity is likely to become relatively high.

In particular, in samples Nos. 9, 10, 12, and 29, in which the distance B was set to 0.7 mm or greater, penetration incidence was 0% even in the case where the spark discharge gap G was set to 1.5 mm (even under the conditions under which penetration is likely to occur). Therefore, it was confirmed that these samples can effectively restrain penetration of discharge through the insulator under such conditions. Although the test results of samples Nos. 4 and 5 which differed from each other only in the outer diameter of the front end of the main body portion show that the smaller the diameter of the main body portion (the center electrode), the greater the possibility of occurrence of penetration of discharge through the insulator, it was found from the test results of sample No. 29 that, even in the case where the outer diameter of the front end of the main body portion is set to 1.9 mm (even under the conditions under which penetration is very likely to occur), penetration of discharge through the insulator can be restrained effectively by setting the distance B to 0.7 mm or greater. That is, setting the distance B to 0.7 mm or greater is considered very effective for restraining penetration of discharge through the insulator.

Further, it was confirmed that, as shown in Table 1 and FIG. 5, samples Nos. 13 to 15, in which the distance C was set to 0.05 mm or less, were quite excellent in penetration resistance. Conceivably, this excellent penetration resistance was attained in the following mechanism. As a result of decreasing the distance between the center electrode (the main body portion) and the insulator, heat of the insulator was efficiently conducted to the center electrode, whereby an increase in the temperature of the insulator was suppressed. Thus, excellent penetration resistance was attained.

In addition, it became clear that, as shown in Table 1 and FIG. 6, samples Nos. 17 and 18, in which the thickness D was set to 0.6 mm or less, can quite effectively restrain penetration of discharge through the insulator. Conceivably, this effective restraint of penetration was attained, because conduction of heat of the insulator to the inner layer of the center electrode, which is excellent in thermal conductivity, is promoted, whereby an increase in the temperature of the insulator was suppressed.

Additionally, it was found that, as shown in Table 1 and FIG. 7, by setting the distance L to 11 mm or less (samples Nos. 21 to 24), excellent penetration resistance was realized. Conceivably, this excellent penetration resistance was attained in the following mechanism. As a result of rendering the distance L relatively short, heat of the insulator was efficiently conducted to the metallic shell via the center electrode, whereby an increase in the temperature of the insulator was suppressed. Thus, excellent penetration resistance was attained.

Also, it was found that, in the case of sample No. 27 having a chamfer portion, although penetration of discharge through the insulator is more likely to occur because of the distance E being set to 0.15 mm, penetration of discharge through the insulator can be restrained quite effectively. Conceivably, this restraint was attained because the electric field intensity between the front end surface and inner circumferential surface of the metallic shell decreased due to provision of the chamfer portion.

The above-described test results reveal that, in a spark plug in which the thickness A of the insulator is set to 0.6 mm or less and the center electrode has the space-forming portion and which is more likely to cause penetration of discharge through the insulator, preferably, the distance B (as measured along the axis CL1) between the front end of the metallic shell and the boundary portion between the space-forming portion and the main body portion is set to 0.4 mm or greater in order to restrain penetration of discharge through the insulator.

Also, in order to more reliably restrain penetration of discharge through the insulator, preferably, the distance B is set to 0.7 mm or greater, the clearance C is set to 0.05 mm or greater, the thickness D is set to 0.6 mm or less, the distance L is set to 11 mm or less, and/or a chamfer portion is provided between the front end surface and inner circumferential surface of the metallic shell.

Notably, in spark plugs which are large in the distance E and which are likely to cause penetration of discharge through the insulator, setting the distance B, etc. to fall within the above-mentioned respective numerical ranges is particularly effective. In other words, setting the distance B, etc. to fall within the above-mentioned respective numerical ranges is effective for spark plugs in which the distance E was set to 0.05 mm or greater, and more effective for spark plugs in which the distance E was set to 0.10 mm or greater.

The present invention is not limited to the above-described embodiment, but may be embodied, for example, as follows. Of course, applications and modifications other than those exemplified below are also possible.

Figure 8:
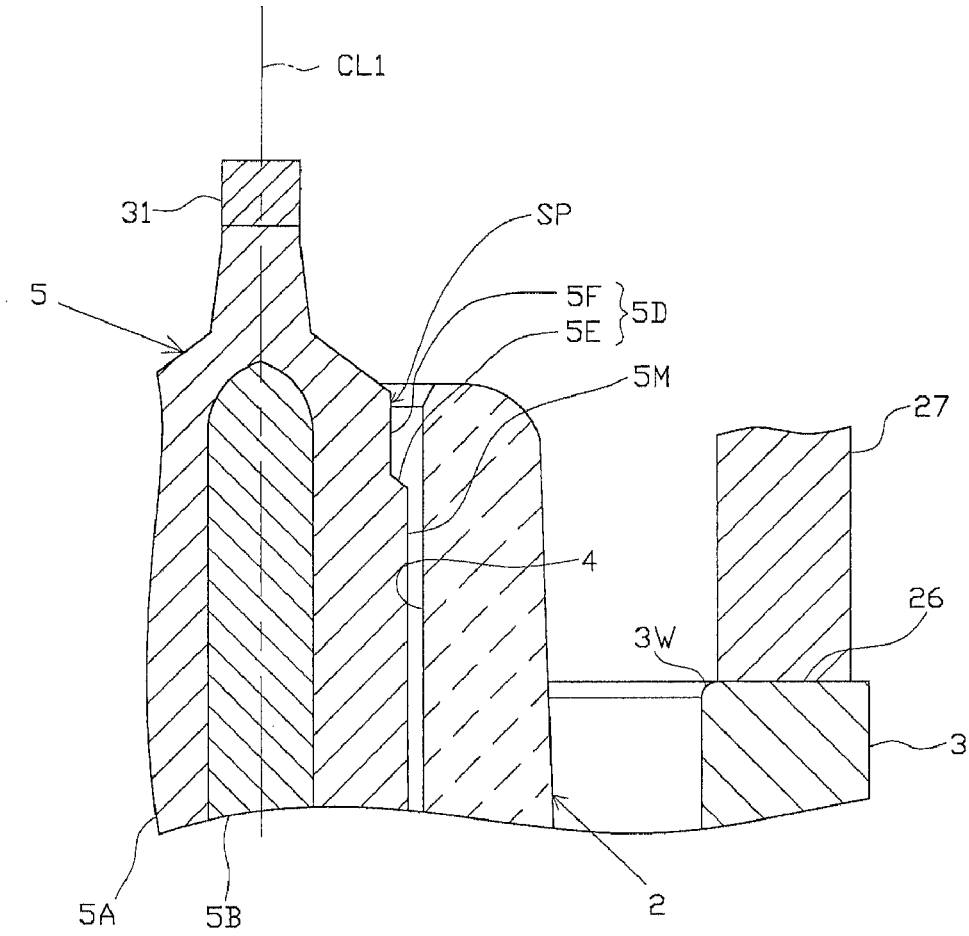
FIG. 8 is an enlarged partial cross section showing the configuration of a metallic shell according to another embodiment.

(a) In the above-described embodiment, the chamfer portion 3T is provided between the front end surface and inner circumferential surface of the metallic shell 3. However, as shown in FIG. 8, instead of the chamfer portion 3T, a curved surface portion 3W, which is convex outward, may be provided. Even in such a case, the electric field intensity between the front end surface and inner circumferential surface of the metallic shell 3 can be lowered, whereby penetration of discharge through the insulator 2 can be prevented more reliably. Notably, from the viewpoint of lowering the electric field intensity more reliably, preferably, the radius of curvature of the curved surface portion 3W is set to 0.1 mm or greater.

(b) In the above-described embodiment, the noble metal portion 31 is provided at the front end of the center electrode 5, and the noble metal tip 32 is provided at the distal end of the ground electrode 27. However, at least one of the noble metal portion 31 and the noble metal tip 32 may be omitted.

(c) In the above-described embodiment, the ground electrode 27 is formed of a single alloy. However, the ground electrode 27 may be formed to have a multi-layer structure; i.e., may have an outer layer and an inner layer provided inside the outer layer and formed of copper, copper alloy, or the like which are excellent in thermal conductivity.

(d) In the above-described embodiment, the present invention is applied to a spark plug in which the ground electrode 27 is joined to the front end 26 of the metallic shell 3. However, the present invention can be applied to a spark plug in which its ground electrode is formed, through cutting operation, from a portion of the metallic shell (or a portion of a front end metal piece welded to the metallic shell in advance (see, for example, Japanese Patent Application Laid-Open (kokai) No. 2006-236906).

(e) In the above-described embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

(f) In the above-described embodiment, the ring members 23, 24 and the talc 25 are disposed between the metallic shell 3 and the insulator 2. However, the ring members 23, 24 and the talc 25 may be omitted. In such a case, the crimp portion 20 is brought into direct contact with the large-diameter portion 11 by means of applying a compression force to the rear end portion of the metallic shell 3 in the direction of the axis CL1, while heating the metallic shell 3 through supply of electricity thereto (by performing so-called hot crimping).

[Description of Reference Numerals]

| | |
|---|---|
| 1: | spark plug |
| 2: | insulator |
| 3: | metallic shell |
| 3T: | chamfer portion |
| 3W: | curved surface portion |
| 4: | axial hole |
| 5: | center electrode |
| 5A: | outer layer |
| 5B: | inner layer |
| 5D: | space-forming portion |
| 5E: | step portion |
| 5F: | circular columnar portion |
| 5M: | main body portion |
| 14: | taper portion |
| 15: | threaded portion |
| 21: | step portion |
| CL1: | axis |
| SP: | annular space |

The invention claimed is:

1. A spark plug comprising:

a tubular metallic shell extending in a direction of an axis;

a tubular insulator provided in the metallic shell, having a front end located frontward of a front end of the metallic shell in the direction of the axis, and having an axial hole extending in the direction of the axis; and a center electrode inserted into the axial hole and having a space-forming portion which forms, in cooperation with a wall surface of the axial hole, an annular space which is open frontward in the direction of the axis, and a main body portion extending rearward from a rear end of the space-forming portion and having a diameter greater than that of the space-forming portion, the spark plug being wherein the insulator has a thickness of 0.6 mm or less as measured on a cross section which is orthogonal to the axis and contains the front end of the metallic shell; and a distance, as measured along the axis, between a boundary portion and the front end of the metallic shell is set to 0.4 mm or greater, said boundary portion being formed between the space-forming portion and the main body portion.

2. A spark plug according to claim 1, wherein the distance, as measured along the axis, between the boundary portion and the front end of the metallic shell is set to 0.7 mm or greater, said boundary portion being formed between the space-forming portion and the main body portion.

3. A spark plug according to claim 1, wherein a clearance between the center electrode and a wall surface of the axial hole is set to 0.05 mm or less as measured on a cross section which is orthogonal to the axis and contains the rear end of the space-forming portion.

4. A spark plug according to claim 1, wherein the center electrode includes an outer layer formed of a nickel alloy and an inner layer formed of a material which is higher in thermal conductivity than the outer layer;

a front end of the inner layer is located frontward of the front end of the metallic shell with respect to the direction of the axis; and the outer layer has a thickness of 0.6 mm or less as measured on a cross section which is orthogonal to the axis and contains the front end of the metallic shell.

5. A spark plug according to claim 1, wherein the insulator has a taper portion whose diameter increases rearward with respect to the direction of the axis, and is brought into direct or indirect contact with a step portion provided on the inner circumference of the metallic shell; and a distance, as measured along the axis, between the front end of the insulator and a rear end of the taper portion is set to 11 mm or less.

6. A spark plug according to claim 1, wherein the space-forming portion includes a step portion whose diameter decreases frontward, with respect to the direction of the axis, from the front end of the main body portion, and a circular columnar portion extending frontward, with respect to the direction of the axis, from a front end of the step portion; and a half a difference in outer diameter between the rear end of the circular columnar portion and the front end of the main body portion is 0.05 mm or greater.

7. A spark plug according to claim 1, wherein a tapered chamfer portion or a curved surface portion which is convex outward is formed between a front end surface and an inner circumferential surface of the metallic shell.

8. A spark plug according to claim 1, wherein the metallic shell has, on its outer circumferential surface, a threaded portion for screwing the spark plug into a mounting hole of a combustion apparatus; and the threaded portion has a nominal diameter of M10 or less.

9. A spark plug according to claim 2, wherein a clearance between the center electrode and a wall surface of the axial hole is set to 0.05 mm or less as measured on a cross section which is orthogonal to the axis and contains the rear end of the space-forming portion.

10. A spark plug according to claim 2, wherein the center electrode includes an outer layer formed of a nickel alloy and an inner layer formed of a material which is higher in thermal conductivity than the outer layer;

a front end of the inner layer is located frontward of the front end of the metallic shell with respect to the direction of the axis; and the outer layer has a thickness of 0.6 mm or less as measured on a cross section which is orthogonal to the axis and contains the front end of the metallic shell.

11. A spark plug according to claim 3, wherein the center electrode includes an outer layer formed of a nickel alloy and an inner layer formed of a material which is higher in thermal conductivity than the outer layer;

a front end of the inner layer is located frontward of the front end of the metallic shell with respect to the direction of the axis; and the outer layer has a thickness of 0.6 mm or less as measured on a cross section which is orthogonal to the axis and contains the front end of the metallic shell.

12. A spark plug according to claim 2, wherein the insulator has a taper portion whose diameter increases rearward with respect to the direction of the axis, and is brought into direct or indirect contact with a step portion provided on the inner circumference of the metallic shell; and a distance, as measured along the axis, between the front end of the insulator and a rear end of the taper portion is set to 11 mm or less.

13. A spark plug according to claim 3, wherein the insulator has a taper portion whose diameter increases rearward with respect to the direction of the axis, and is brought into direct or indirect contact with a step portion provided on the inner circumference of the metallic shell; and a distance, as measured along the axis, between the front end of the insulator and a rear end of the taper portion is set to 11 mm or less.

14. A spark plug according to claim 4, wherein the insulator has a taper portion whose diameter increases rearward with respect to the direction of the axis, and is brought into direct or indirect contact with a step portion provided on the inner circumference of the metallic shell; and a distance, as measured along the axis, between the front end of the insulator and a rear end of the taper portion is set to 11 mm or less.

15. A spark plug according to claim 2, wherein the space-forming portion includes a step portion whose diameter decreases frontward, with respect to the direction of the axis, from the front end of the main body portion, and a circular columnar portion extending frontward, with respect to the direction of the axis, from a front end of the step portion; and a half a difference in outer diameter between the rear end of the circular columnar portion and the front end of the main body portion is 0.05 mm or greater.

16. A spark plug according to claim 3, wherein the space-forming portion includes a step portion whose diameter decreases frontward, with respect to the direction of the axis, from the front end of the main body portion, and a circular columnar portion extending frontward, with respect to the direction of the axis, from a front end of the step portion; and a half a difference in outer diameter between the rear end of the circular columnar portion and the front end of the main body portion is 0.05 mm or greater.

17. A spark plug according to claim 4, wherein the space-forming portion includes a step portion whose diameter decreases frontward, with respect to the direction of the axis, from the front end of the main body portion, and a circular columnar portion extending frontward, with respect to the direction of the axis, from a front end of the step portion; and a half a difference in outer diameter between the rear end of the circular columnar portion and the front end of the main body portion is 0.05 mm or greater.

18. A spark plug according to claim 5, wherein the space-forming portion includes a step portion whose diameter decreases frontward, with respect to the direction of the axis, from the front end of the main body portion, and a circular columnar portion extending frontward, with respect to the direction of the axis, from a front end of the step portion; and a half a difference in outer diameter between the rear end of the circular columnar portion and the front end of the main body portion is 0.05 mm or greater.

19. A spark plug according to claim 2, wherein a tapered chamfer portion or a curved surface portion which is convex outward is formed between a front end surface and an inner circumferential surface of the metallic shell.

20. A spark plug according to claim 3, wherein a tapered chamfer portion or a curved surface portion which is convex outward is formed between a front end surface and an inner circumferential surface of the metallic shell.

21. A spark plug according to claim 4, wherein a tapered chamfer portion or a curved surface portion which is convex outward is formed between a front end surface and an inner circumferential surface of the metallic shell.

22. A spark plug according to claim 5, wherein a tapered chamfer portion or a curved surface portion which is convex outward is formed between a front end surface and an inner circumferential surface of the metallic shell.

23. A spark plug according to claim 6, wherein a tapered chamfer portion or a curved surface portion which is convex outward is formed between a front end surface and an inner circumferential surface of the metallic shell.

24. A spark plug according to claim 2, wherein the metallic shell has, on its outer circumferential surface, a threaded portion for screwing the spark plug into a mounting hole of a combustion apparatus; and the threaded portion has a nominal diameter of M10 or less.

25. A spark plug according to claim 3, wherein the metallic shell has, on its outer circumferential surface, a threaded portion for screwing the spark plug into a mounting hole of a combustion apparatus; and the threaded portion has a nominal diameter of M10 or less.

26. A spark plug according to claim 4, wherein the metallic shell has, on its outer circumferential surface, a threaded portion for screwing the spark plug into a mounting hole of a combustion apparatus; and the threaded portion has a nominal diameter of M10 or less.

27. A spark plug according to claim 5, wherein the metallic shell has, on its outer circumferential surface, a threaded portion for screwing the spark plug into a mounting hole of a combustion apparatus; and the threaded portion has a nominal diameter of M10 or less.

28. A spark plug according to claim 6, wherein the metallic shell has, on its outer circumferential surface, a threaded portion for screwing the spark plug into a mounting hole of a combustion apparatus; and the threaded portion has a nominal diameter of M10 or less.

29. A spark plug according to claim 7, wherein the metallic shell has, on its outer circumferential surface, a threaded portion for screwing the spark plug into a mounting hole of a combustion apparatus; and the threaded portion has a nominal diameter of M10 or less.

* * * * *